US006360452B1

(12) United States Patent
De Gracia

(10) Patent No.: US 6,360,452 B1
(45) Date of Patent: Mar. 26, 2002

(54) DRYING TUNNEL FOR FRUIT AND VEGETABLES

(75) Inventor: Antonio Ramon De Gracia, Valencia (ES)

(73) Assignee: Food Machinery Espanola S.A. (ES)

( * ) Notice: Subject to any disclaimer, the term of this patent is extended or adjusted under 35 U.S.C. 154(b) by 0 days.

(21) Appl. No.: 09/497,426

(22) Filed: Feb. 3, 2000

(51) Int. Cl.[7] ..... F26B 11/18

(52) U.S. Cl. ..... 34/203; 34/205; 34/207; 34/211; 34/217; 34/236

(58) Field of Search ..... 34/203, 205, 207, 34/209, 211, 217, 236; 198/509, 603, 611; 414/150, 152, 157

(56) References Cited

U.S. PATENT DOCUMENTS 4,479,310 A * 10/1984 Duc ..... 34/482
5,050,318 A * 9/1991 Du Bruyn ..... 34/217
5,105,563 A * 4/1992 Fingerson et al. ..... 34/203
6,055,741 A * 5/2000 Ledermann et al. ..... 34/129

* cited by examiner

*Primary Examiner*—Pamela Wilson
(74) *Attorney, Agent, or Firm*—Lackenbach Siegel

(57) ABSTRACT

The object of the Patent is a drying tunnel for fruit and vegetables which is prismatic rectangular in shape and is internally divided by spacing walls (1) with a bucket conveyor travelling successively up and down.

The buckets are elongate, parallel to the walls (1) and closed at their ends by irregular hexagonal plates (2) which may swivel about top half-shafts (3), their concave bottom allowing an airflow through it and consisting of longitudinal spaced rods (4).

Shafts (5) are arranged at the top of the end walls (2) with bearing means (6) at their free end which, upon abutting on a flat inclined guide (7), cause the bucket to be tipped and emptied, allowing the fruit to exit.

3 Claims, 2 Drawing Sheets

DRYING TUNNEL FOR FRUIT AND VEGETABLES

1—OBJECT

The object of the present invention is a "Drying tunnel for fruit and vegetables".

The tunnel, preferably arranged with the fruit or vegetables ravelling vertically, works with fresh fruit and vegetables and is designed to eliminate the surface moisture they retain after undergoing the pre-packing operations (washing, polishing).

2—PRIOR ART

Drying tunnels are known in the prior art of handling fruit and vegetables to improve their market presentation in which the fruit and vegetables move forward on horizontally arranged roller conveyors, whilst they are rubbed by a mass of hot air forced to flow upstream.

Where airflow and temperature are the same, process efficiency depends on the length of the contact between the mass of gas and the fruit or vegetables and therefore, in conclusion, on the tunnel length.

This constraint is sometimes difficult to satisfy, given the limited plan surface available at handling warehouses.

3—DESCRIPTION OF THE INVENTION

The invention subject of this Patent is designed to overcome the drawback typical of known horizontal drying tunnels described above.

It is therefore designed as a prismatic rectangular box which is internally divided by parallel equidistant vertical walls into preferably identical compartments with a bucket conveyor travelling successively up and down as a continuous chain, arranged so that the compartments each contain a conveyor sector moving in a direction opposite that in which the adjacent compartment is travelling.

The buckets are elongate and their horizontal axis lies parallel to the compartment walls, their ends each being limited by irregular hexagonal plates, swivel hinge pin sectors being located close to each of their top corners, ideally in line, joined to the respective chains driving the conveyor.

The bottom of the bucket that is to hold the fruit whilst it is conveyed within the tunnel is arranged within the concavity defined by the three bottom corners of the end hexagonal walls, made in such a way as to allow an airflow through it (for instance, spaced longitudinal rods, perforated plate, etc.).

Short shafts are arranged projecting from the bucket at each of the top inner corners of said hexagonal walls, their free ends each provided with bearing means (bearings for instance) which, in the last downward sector of the conveyor, abut against flat symmetrical guides with a downward incline, causing the bucket to swivel upon abutting thereon, thereby for it to be tipped and emptied, allowing the fruit it held and conveyed to leave the tunnel.

The height at which the fruit exits may be optionally chosen by adjusting the position of the flat tipping guide, which may move vertically along a C section, being fixed thereto at the desired position.

The top of the general prismatic rectangular box of the tunnel has conventional means for heating and forcing the flow of the drying air mass, and a motor driving the inner conveyor.

The drying tunnel designed with the above-mentioned structural, formal and functional characteristics provides a number of advantages over known tunnels travelling horizontally, for instance as follows:

a)—Less plan surface area is taken up, with the same length of travel of the fruit inside the tunnel, or even with a greater length.

b)—Total contact of the airflow with the fruit, sweeping its upper face in the upward sectors of the conveyor and its lower face through the bottom of the buckets in the downward sectors thereof, and consequently making operation more efficient.

c)—Adjustment of the height at which the fruit exits, fixing it as appropriate to facilitate the subsequent handling thereof.

d)—A rational replacement of air losses by optionally fitting a moisture control sensor which may, through electronic means, provide for the adjustment of the airflow entering from outside in order to be as strictly required to keep the physical constants at their optimum values.

4—BRIEF DESCRIPTION OF THE DRAWINGS

In order for the description of the invention to be complete and for its formal, structural and functional characteristics to be more easily understood, a number of drawings are attached schematically showing various features of a preferred embodiment of the drying tunnel for fruit and vegetables subject of the present Letters Patent.

5—DESCRIPTION OF A PREFERRED EMBODIMENT

Figure 1:
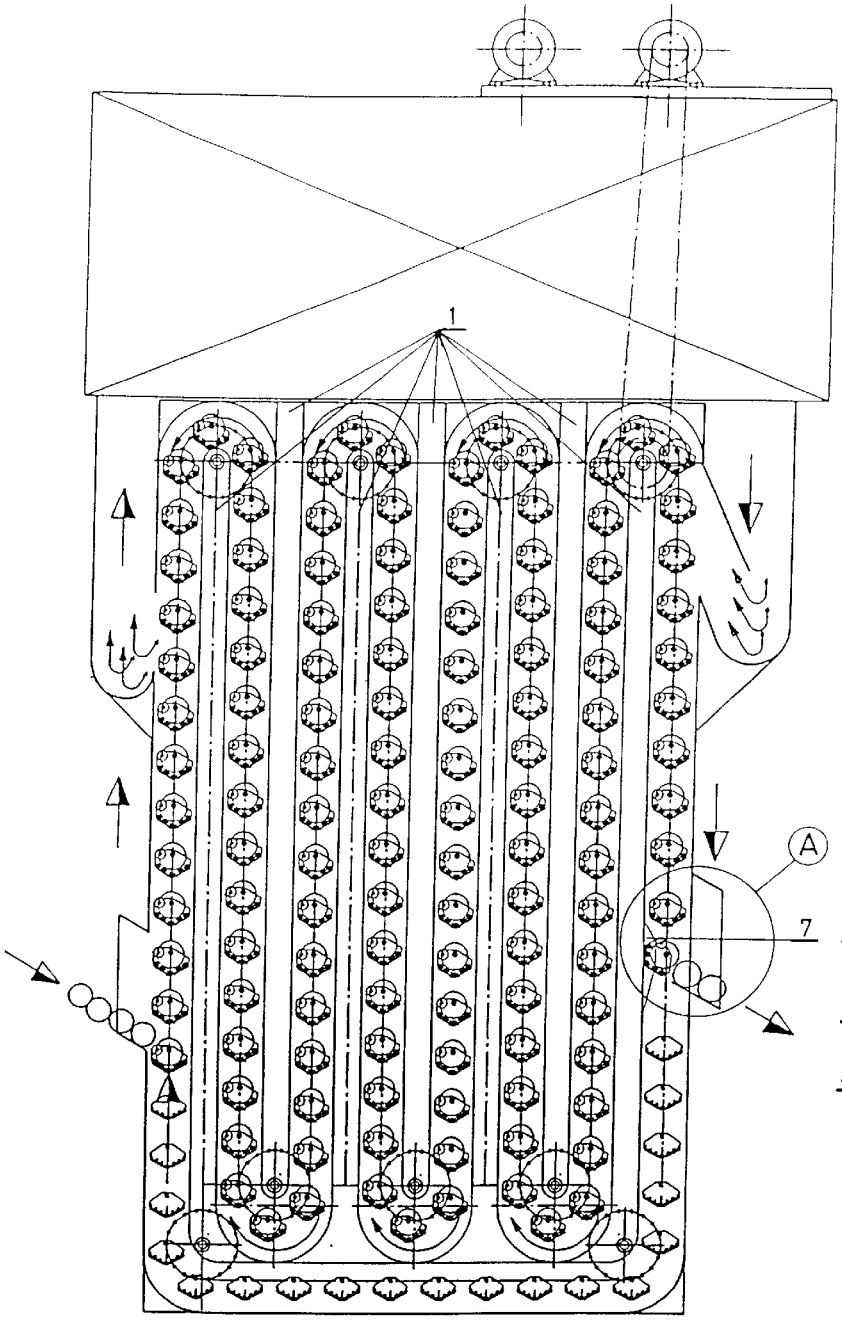
FIG. 1 is a side elevation view of the drying tunnel, with the front enclosing plate removed to show its internal characteristics.
Figure 2:
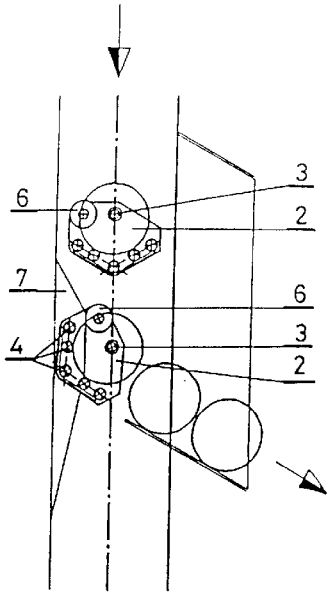
FIG. 2 is an enlargement of detail A relating to the bucket swivelling, tipping and emptying system for the fruit to leave the inside of the tunnel.
Figure 4:
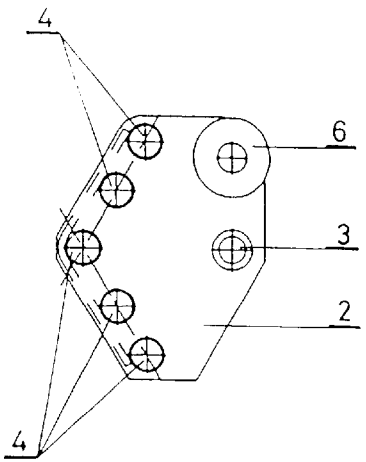
Figure 3:
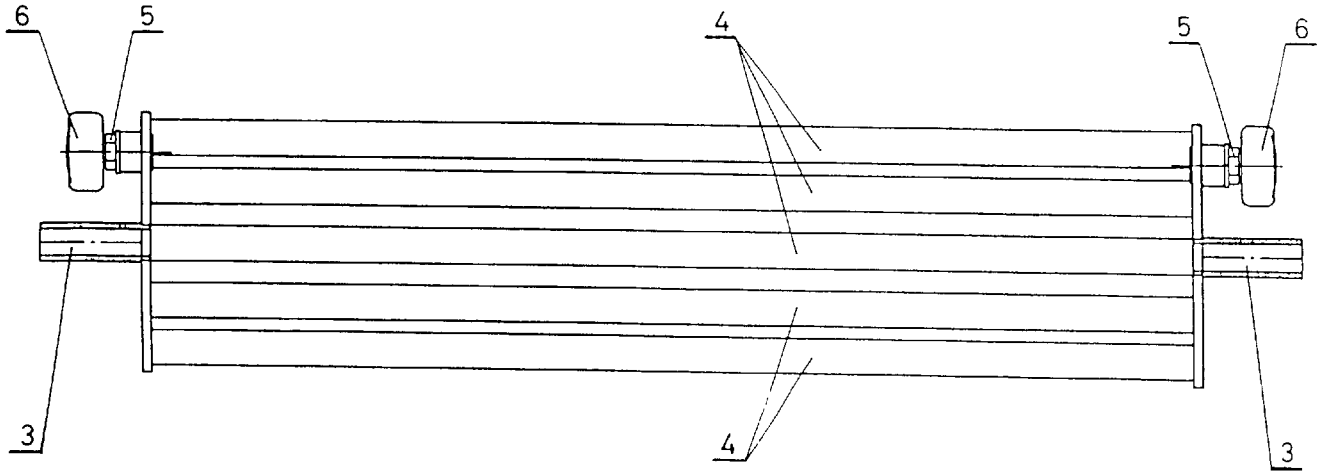
FIG. 3 is a plan view of a bucket and FIG. 4 a side view thereof.

In order to clearly show the nature and scope of advantageous application of the drying tunnel for fruit and vegetables subject of the invention, its structure and operation will now be described with reference to the drawings, which represent a preferred embodiment of said object for informative purposes and should therefore be construed in the broadest sense and not so to limit the application and contents of the invention.

The drying tunnel is shaped as a prismatic rectangular box which is internally divided by parallel equidistant vertical walls (1) into preferably identical compartments with a bucket conveyor travelling successively up and down as a continuous chain, arranged so that the compartments each contain a conveyor sector moving in a direction opposite that in which the adjacent compartment is travelling.

The buckets are elongate and their horizontal axis lies parallel to the compartment walls (1), their ends each being limited by irregular hexagonal plates (2), swivel hinge pin sectors (3) being located close to each of their top corners, ideally in line, joined to the respective chains driving the conveyor.

The bottom of the bucket is arranged within the concavity defined by the three bottom corners of the end hexagonal walls (2), made in such a way as to allow an airflow through it, with spaced longitudinal rods (4).

Short shafts (5) are each arranged projecting from the bucket at the top inner corner of each end wall (2) of the buckets, their free ends each provided with bearing means (bearings (6) for instance) which, in the last downward sector of the conveyor, abut against flat symmetrical guides (7) with a downward incline, causing the bucket to swivel upon abutting thereon, thereby for it to be tipped and emptied, allowing the fruit it held and conveyed to leave the tunnel.

The height at which the fruit exits may be chosen by adjusting the position of the tipping guide (7), moving it vertically along a C section, to which it may be fixed at the desired position.

What is claimed is:

1. A drying tunnel for fruit and vegetables characterized in that it is shaped as a prismatic rectangular box which is internally divided by spacing walls (1) into compartments with a bucket conveyor traveling successively up and down as a continuous chain, arranged to that the compartments each contain a conveyor sector moving in a direction opposite that in which the adjacent compartment is traveling.

2. A drying tunnel for fruit and vegetables, as in claim 1, characterized in that the buckets are elongate and their horizontal axis lies parallel to the compartment walls (1), the bucket ends each being limited by hexagonal walls (2) swivel hinge pin sectors (3) being located close to each of their top corners, joined to the respective chains driving the conveyor; whereas the bottom of the bucket is arranged within the concavity defined by the hexagonal walls (2), made in such a way as to allow an airflow through it, with spaced longitudinal rods (4).

3. A drying tunnel for fruit and vegetables, as in the preceding claims, characterized in that shafts (5) are each arranged projecting from the bucket at the top corner of each wall (2) of the buckets, their free ends each provided with bearings (6) which, in a downward sector the conveyor, abut against guide (7) with a downward incline, causing the bucket to swivel upon abutting thereon, thereby for the bucket to be tipped and emptied, allowing the fruit held and conveyed to leave the tunnel, the height at which the fruit exits being chosen by adjusting the position of the guide (7).

* * * * *